US008893934B2

(12) United States Patent
Zhao

(10) Patent No.: US 8,893,934 B2
(45) Date of Patent: Nov. 25, 2014

(54) SELF-ADAPTING CAP SHAPER

(71) Applicant: Jie Zhao, Midlothian, VA (US)

(72) Inventor: Jie Zhao, Midlothian, VA (US)

( * ) Notice: Subject to any disclaimer, the term of this patent is extended or adjusted under 35 U.S.C. 154(b) by 0 days.

(21) Appl. No.: 14/021,001

(22) Filed: Sep. 9, 2013

(65) Prior Publication Data

US 2014/0069965 A1 Mar. 13, 2014

Related U.S. Application Data

(60) Provisional application No. 61/698,166, filed on Sep. 7, 2012.

(51) Int. Cl.

| | |
|---|---|
| ***A42C 1/04*** | (2006.01) |
| ***A42C 1/08*** | (2006.01) |
| ***A42B 1/00*** | (2006.01) |
| *A42B 1/02* | (2006.01) |

(52) U.S. Cl.
CPC .. *A42C 1/08* (2013.01); *A42B 1/002* (2013.01)
USPC ..... 223/12; 2/195.5

(58) Field of Classification Search
USPC ..... 223/8, 12, 15, 17, 22, 66, 84; 2/182.2, 2/182.4, 175.4, 175.5, 195.5; D2/887, D2/892
See application file for complete search history.

(56) References Cited

U.S. PATENT DOCUMENTS

| | | | | | |
|---|---|---|---|---|---|
| 1,485,086 | A | * | 2/1924 | Mead | 2/181.4 |
| 1,656,073 | A | * | 1/1928 | Nixon | 2/181 |
| 1,877,452 | A | * | 9/1932 | Gagne | 2/195.5 |
| 1,899,636 | A | * | 2/1933 | Raulerson | 2/175.4 |
| 2,418,764 | A | * | 4/1947 | Ford | 2/195.5 |
| 2,491,309 | A | * | 12/1949 | Hanson | 2/181.4 |
| 2,686,919 | A | * | 8/1954 | Schlesinger | 2/209.12 |
| 2,822,549 | A | * | 2/1958 | Glass et al. | 2/195.5 |
| 3,504,380 | A | * | 4/1970 | Gallin | 2/195.5 |
| 5,094,369 | A | * | 3/1992 | Thompson | 223/25 |
| 6,012,173 | A | * | 1/2000 | Lee | 2/195.5 |

* cited by examiner

*Primary Examiner* — Ismael Izaguirre

(57) ABSTRACT

A cap shaper has contact-members adapted for supporting and shaping a cap from its inside; The cap shaper is elastically deformable under external forces, and maintains a generally larger contact-members' collective-outline dimension than that of the cap inside when free from external forces; When placed inside the cap the cap shaper deforms under the confines of the smaller cap inside due to the contact forces exerted to the contact-members from the contacted cap regions, displacing the contact-members, resulting cap shaper internal elastic tension and tendency to expand and substantially self-adapt for the contact-members to contact and fit in with the cap regions of contact, accommodating minor cap size and shape variations, counter balancing the contact forces and maintaining the tensioned contact to shape the cap.

6 Claims, 8 Drawing Sheets

SELF-ADAPTING CAP SHAPER

CROSS-REFERENCE TO RELATED APPLICATIONS

This application claims the benefit of PPA Ser. No. 61/698,166, filed 2012 Sep. 7 by the present inventor.

BACKGROUND

1. Field of Invention

The present invention relates generally to cap shapers. More specifically, it relates to cap shapers for caps made of non-rigid materials to form desired cap shape for purposes including wearing and displaying.

2. Description of Prior Art

Caps or hats in many occasions, such as in wearing and displaying, are often desirable to be in their designed shapes. For caps made of non-rigid materials the desired shapes naturally cannot be reliably formed without assistance due to the non-rigid nature of the material they are made of. To assist forming the desired shape a substantially rigid cap shaper is usually positioned inside the cap for providing support to the cap.

The prior cap shaper insert designs and products have been generally in the following categories:

- A rigid or semi-rigid cap shaper of fixed sizes and dimensions to be inserted into the inside of a cap for supporting and forming a shape for the cap. To accommodate the cap sizes and shape variations the cap shaper would need to be trimmed before use. The trimming is performed manually and often by the users, which involves removing cap shaper material irreversibly to adjusted and fit for one particular cap, therefore are often compromised.
- A substantially rigid or semi-rigid cap shaper formed by two or more sections connected together and provided with manual adjustment mechanism for varying its dimension and shape for optimizing its fit with a cap. However the number of dimensions to be adjusted is often limited and inadequate to shape caps of minor random shape variations from their designs, and the mechanism can be cumbersome for adjusting and wearing, and it can be costly.

In above categories the cap shapers need to be manually adjusted, either by trimming or by adjusting dimensions in order to fit the intended cap, which often are for stationary display and less suitable for wearing. No mechanism exists at the time of this invention for cap shapers to self-adapt to adequately fit for caps of a range of sizes and shape variations.

SUMMARY OF THE INVENTION

The general purpose of the present invention is to provide for caps made with non-rigid materials a new shaper to be positioned inside the cap to support and maintain the desired cap shape for wearing and displaying, substantially self-adaptive to conform to the cap shape and tolerate certain variations of the cap size and shape from its design, to reliably form the desired cap shape for purposes including wearing and displaying.

The present invention is a cap shaper for shaping a cap from its inside, comprising one or more members, the contact-members, with shapes and locations adapted for contacting certain regions of the hat inside of the cap for shaping the cap. The contact-members are interconnected or interjoined by elastic means enabling relative elastic displacement of the contact-members in response to external forces exerted to them, and maintaining a generally larger dimension of a collective outline defined by the contact-members when they are free from external forces, than that of the cap inside, thus when the cap shaper is positioned inside of the cap the smaller confines of the cap inside deforms the cap shaper by exerting contact forces to the contact-members, elastically displacing them, generating elastic tension in the cap shaper and its tendency to expand, which maintains tensioned contact of the contact numbers to the cap, hence shaping the cap.

For caps with shapes that can be defined by the outline of one or more given regions of the cap, the cap-shape-defining-regions, the number of contact-members, their shapes and relative locations on the cap shaper are determined to correspond and contact to that of those regions.

For a concave cap-shape-defining-region, the corresponding contact-member of the shaper can be adapted to be substantially convex and complementary in shape to that of the cap-shape-defining-region, which forms an alignment guide for mutual physical approaching and facilitates substantial self-adaptive process of contact between the contact-member and the-shape-defining-region. As the contact-member approaches by radial elastic displacement closer to its corresponding cap-shape-defining-region the concave of the region guides the contact-member by exerting lateral contact force to the contact-member causing its lateral elastic displacement to approach and align with its final contact with the corresponding region.

For illustrating the present invention, an embodiment of a cap shaper for shaping a cap comprises an cap shaper in the form of a solid loop, inextensible and transversely elastic, having a number of sections of the loop, the contact-members, generally protruding and convexly curved away from the loop, located corresponding to the locations of the cap-shape-defining-regions of the cap and alternately distributed and joined with or extended from a same number of generally concavely curved loop sections, the buffer-sections or elastic-buffers, around the loop; The shapes of the contact-members are adapted for tensioned contact with and supporting the corresponding cap-shape-defining-regions when the cap is positioned inside the cap, and the buffer-sections or elastic-buffers facilitate elastic displacement of the contact-members in respond to external forces.

When free from external force the cap shaper maintains a generally larger dimension defined by a collective outline of the contact-members than that of the cap inside. When positioned inside the cap under confines of the smaller space, the cap shaper elastically deforms, displacing contact-members in response to the contact forces from the cap-shape-defining-regions, resulting in increased internal elastic tension in the cap shaper and its tendency to expand and substantially self-adaptive in shape to conform to the cap inside, tolerating cap shape and size variation within the cap shaper elastic expansion limit, balancing the external contact force and maintaining the shape of the cap.

The flexible self-adaptive nature of the cap shaper of present invention provides major advantages over the prior arts in that it enables a single cap shaper to conform to and fit for caps of various sizes and minor random shape irregularities, eliminating the need for any manual cap shaper adjustment while facilitating adequate cap shaping as well as easy process of positioning and extracting the cap shaper in and out of the cap.

The elasticity of the cap shaper material and the relative dimension difference of a free cap shaper and the shaper when positioned inside the cap are optimized to provide adequate restoring tension in the cap shaper for its self-adaptive shaping of the cap, and to minimize the effort for cap shaper insertion into and extraction out of the cap.

DETAILED DESCRIPTION OF THE PREFERRED EMBODIMENTS

Figure 1:
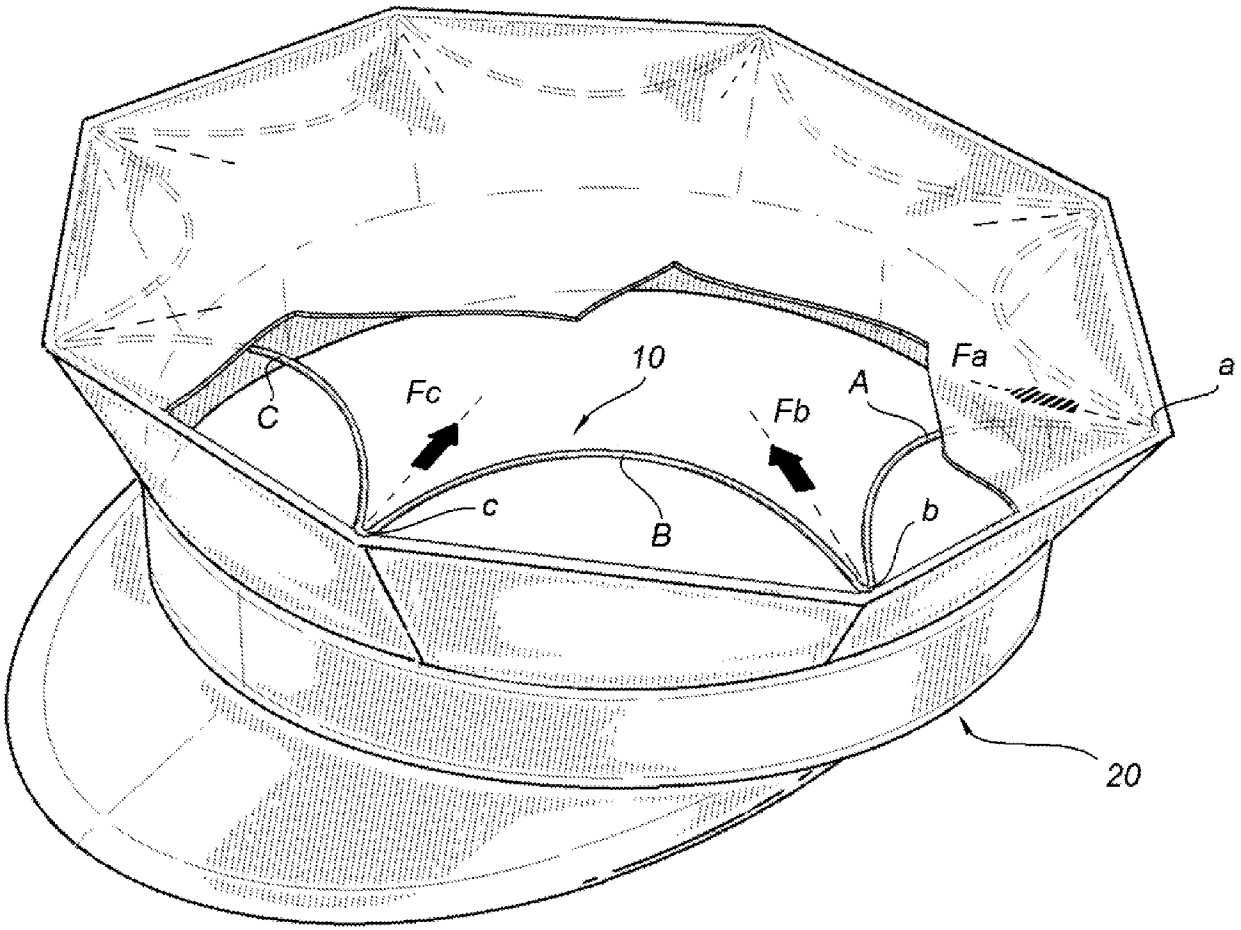
FIG. 1 is an exploded perspective view of a cap with a polygon top rim inserted with a cap shaper of the current invention.

Turning now descriptively to the drawings, in which similar reference characters denote similar elements throughout the several views.

Referring to the drawings, and in particular to FIGS. 1, 2, 3 and 4, a self-adapting cap shaper embodiment according to the present invention is referenced generally by numeral 10, in form of an inextensible and transversely elastic solid loop, for shaping a cap referenced by numeral 20, as shown in FIG. 1, having a polygon shaped cap top defined by the corner points of its perimeter; For illustration an octagon is shown.

The contact-members of cap shaper 10 are the corner-bent sections along the cap shaper loop with convex curvature protruding from the solid loop, three of which are labeled a, b, c for illustration; The number of the contact-members matches that of the corner points of the cap polygon, the cap-shape-defining-regions, and are adapted to each contact and support a corner point of the cap polygon when the cap shaper is positioned inside the cap; The buffer-sections of cap shaper 10 are arches with concave curvature, alternately arranged with the contact-members along the cap shaper loop; Arch A in between bent corners a and b, arch B in between bent corners b and c are labeled for illustration; The cap shaper 10 is shown positioned in the cap 20 in FIG. 1.

Figure 2:
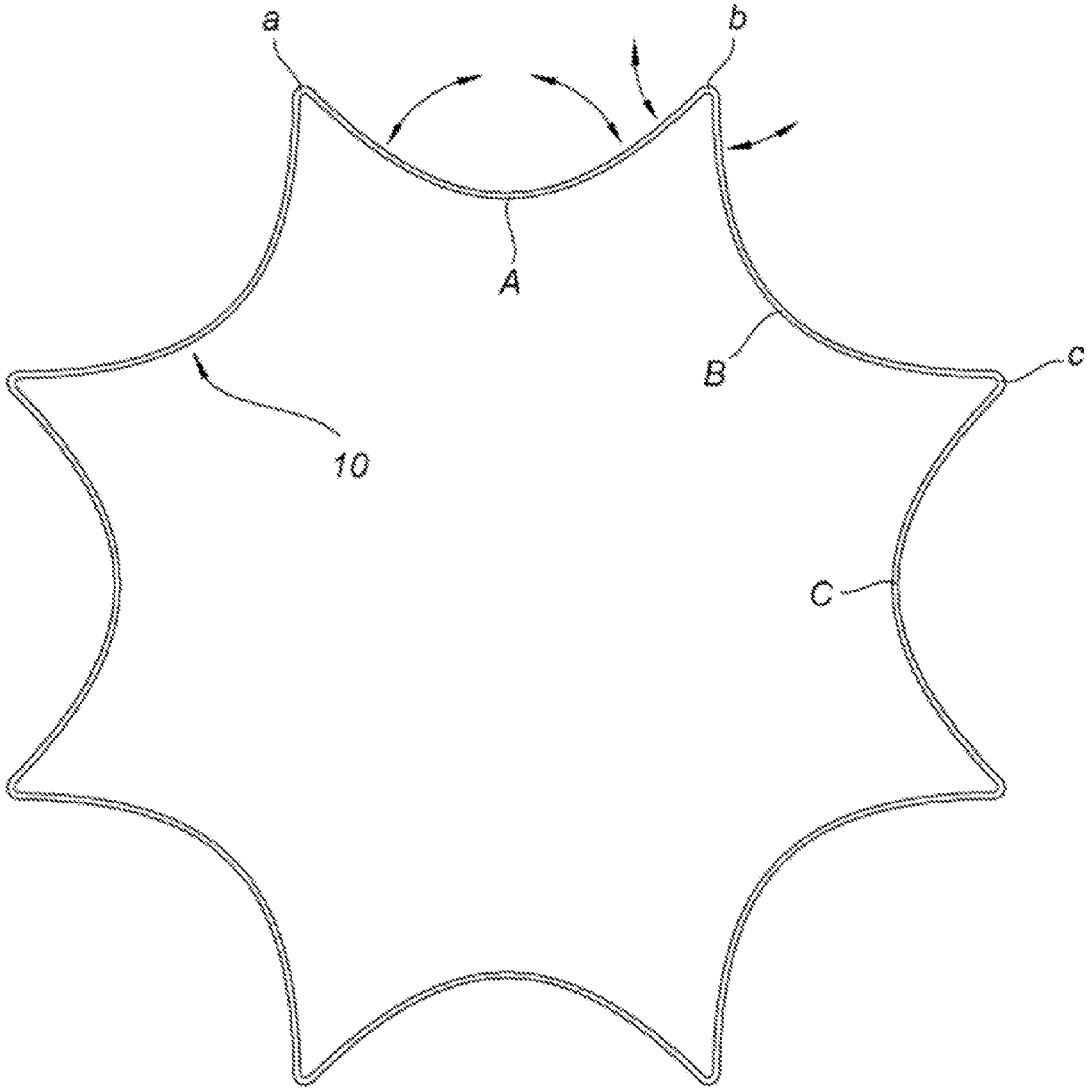
FIG. 2 is a top view of the cap shaper in FIG. 1 in its free form.

In FIG. 2 the cap shaper 10 in its free state is shown; also shown with the arched arrows are the deformability of the cap shaper, including the manners and directions, under external contact forces exerted to the contact-members.

Figure 3:
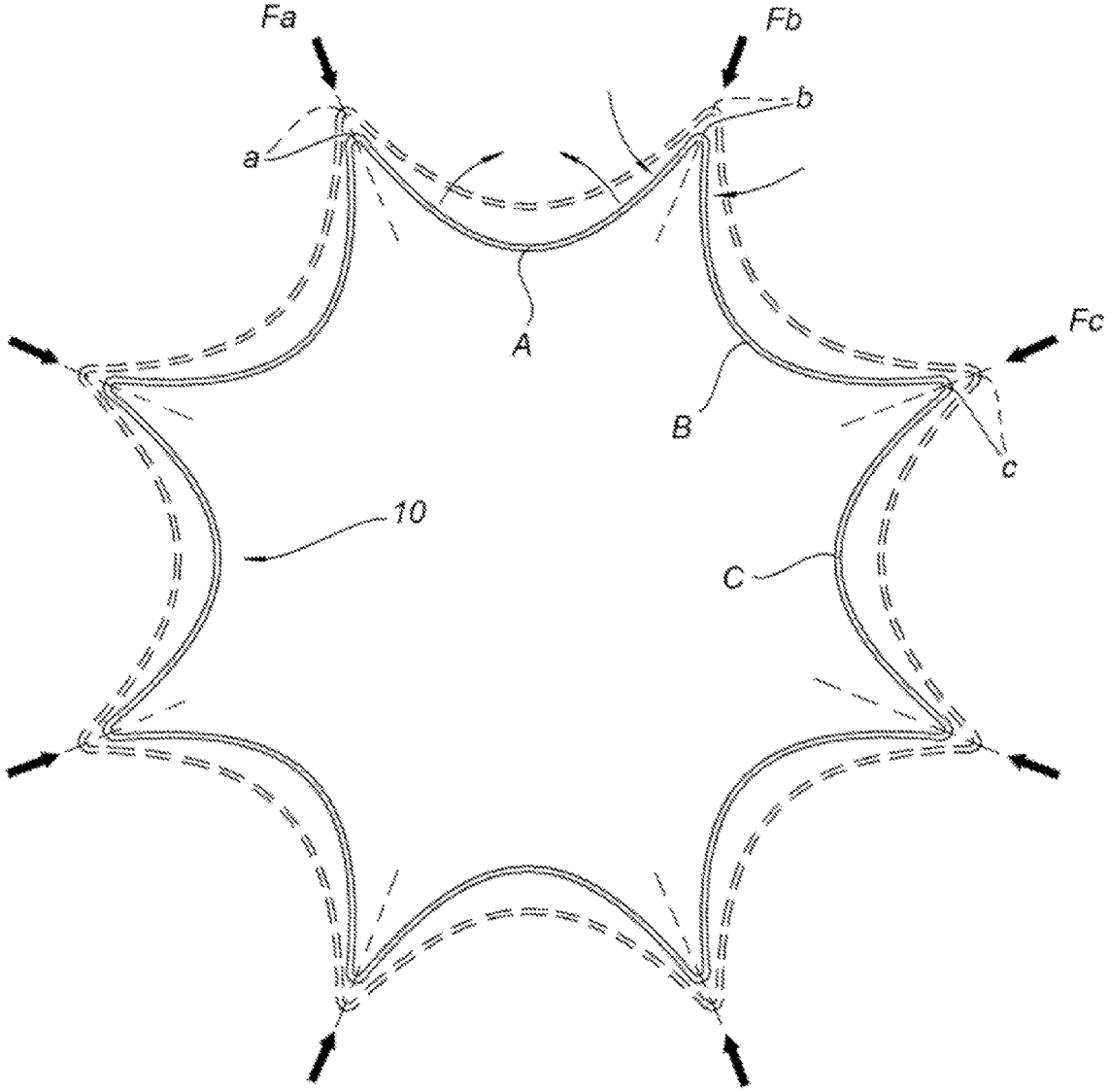
FIG. 3 is a top view comparison of the cap shaper in FIG. 1 in its free form (dashed lines) and its shape (solid lines) when inserted into the cap.

Illustrated in FIG. 3 is a comparison of the state of cap shaper 10 when positioned in cap 20, in solid lines, with that when its free, in dashed lines; The in-position cap shaper is shown deformed from its free state under the contact forces exerted from the inner corners of the cap top octagon to the contact-members, of the cap shaper, for illustration three of the contact forces are labeled Fa, Fb, Fc, as shown also in FIG. 1, exerted to contact-sections a, b, c, respectively; The deformation of the cap shaper as shown in FIG. 1, creates cap shape restoring tension and its tendency to expand, resulting in self-adaptive firm contact of the cap shaper contact-members, the corner bends, to the inside corners of the cap top polygon, the cap-shape-defining-regions, and facilitating adequate shaping for the cap.

Figure 4:
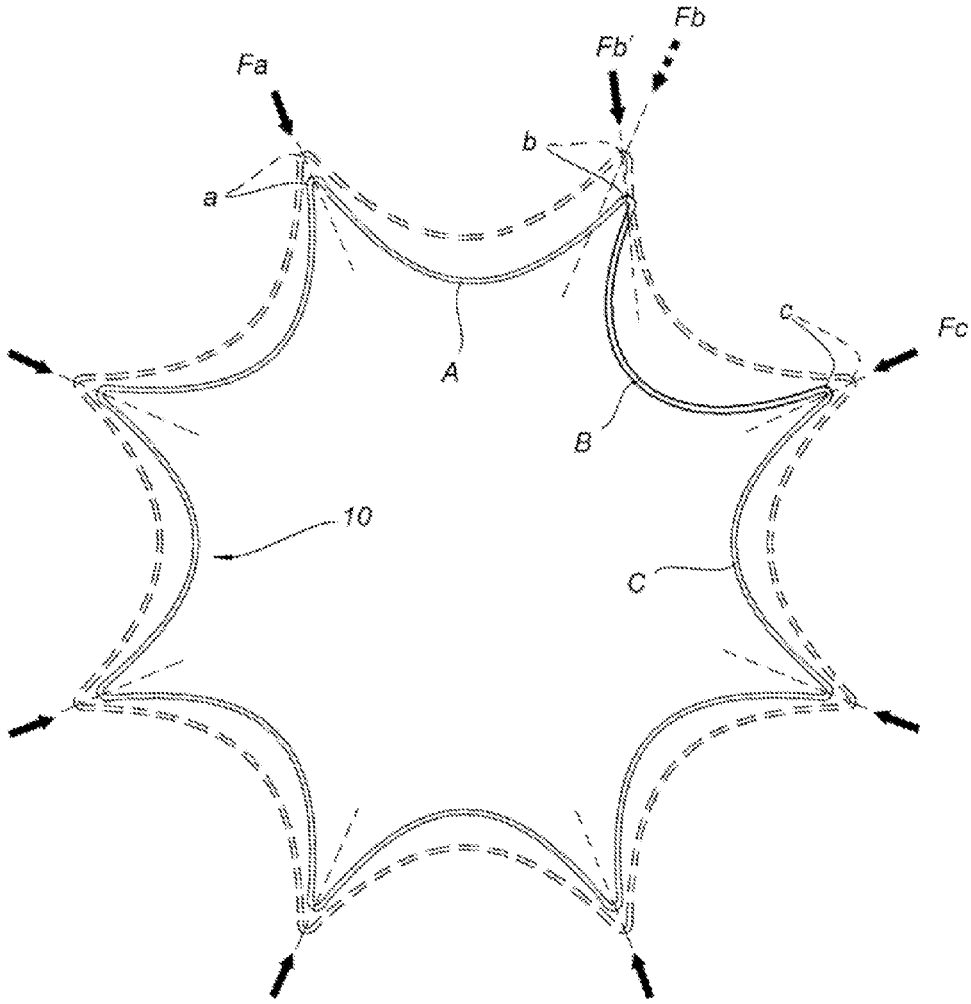
FIG. 4 is a top view of an example of the cap shaper in FIG. 1 self-adapting to minor cap shape variation.

In reality random minor cap shape deviation from its designed shape is inevitable. FIG. 4 illustrates the self-adaptability of the cap shaper embodiment under current invention in an example in which the cap has one corner of the polygon top, corresponding to support-section b, deviating from its normal designed location; When the cap shaper is positioned in the cap, the contact-member b, corner bend b, experiences the contact force Fb' deviated from its normal direction shown as that of Fb (dashed arrow) due to the cap corner position deviation, the lateral component of Fb' causes the buffer-section B to deform more than A, displacing the contact-member b laterally as it expands radially into the position-deviated cap polygon shape corner, relative to other contact-members including a and c, to contact with and provide support to the cap polygon corner, hence in response to cap shape random variations the cap shaper self-adapts to fit in varied cap shape providing adequate support to shape the cap.

Figure 5:
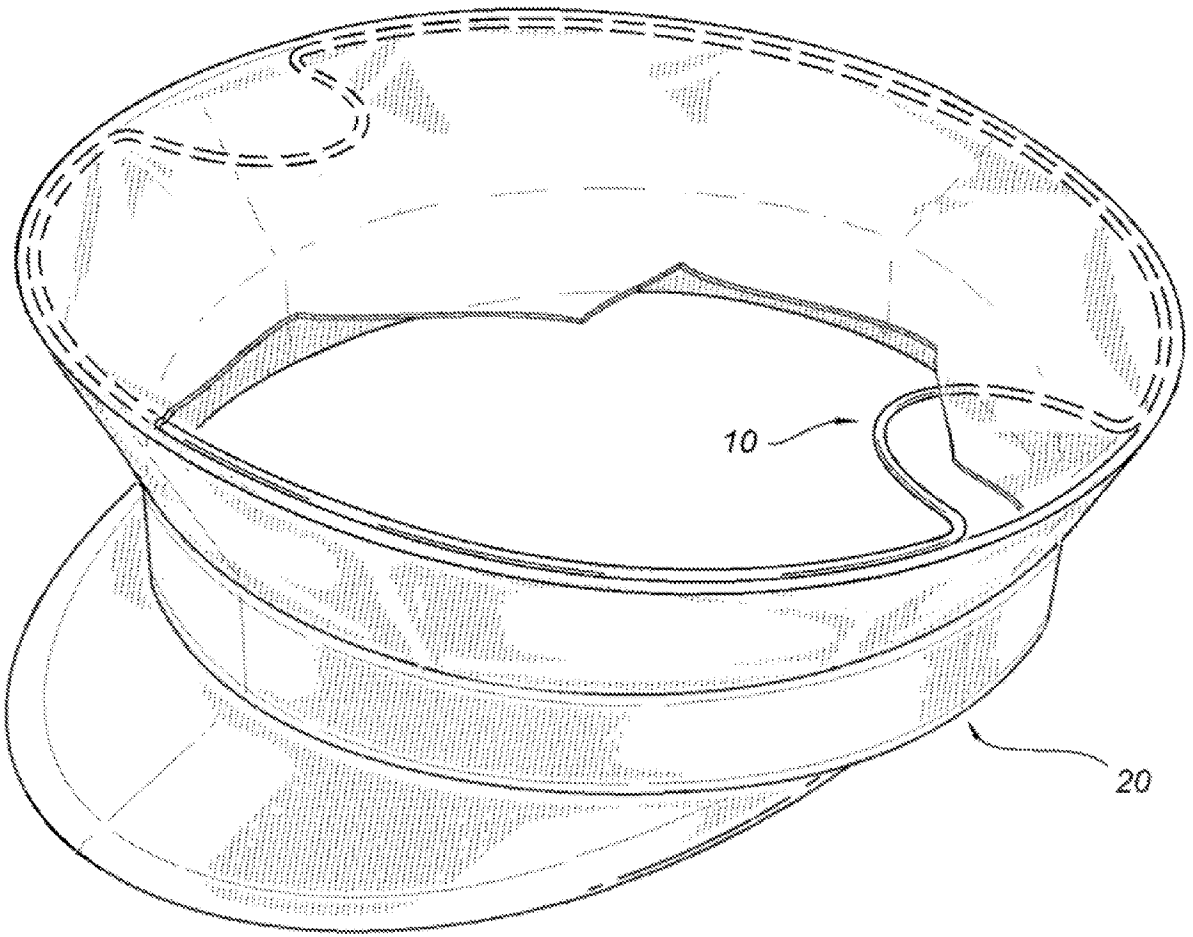
FIG. 5 is an exploded perspective view of a cap with a generally round top rim inserted with an alternative generally round cap shaper embodiment of the current invention.
Figure 6:
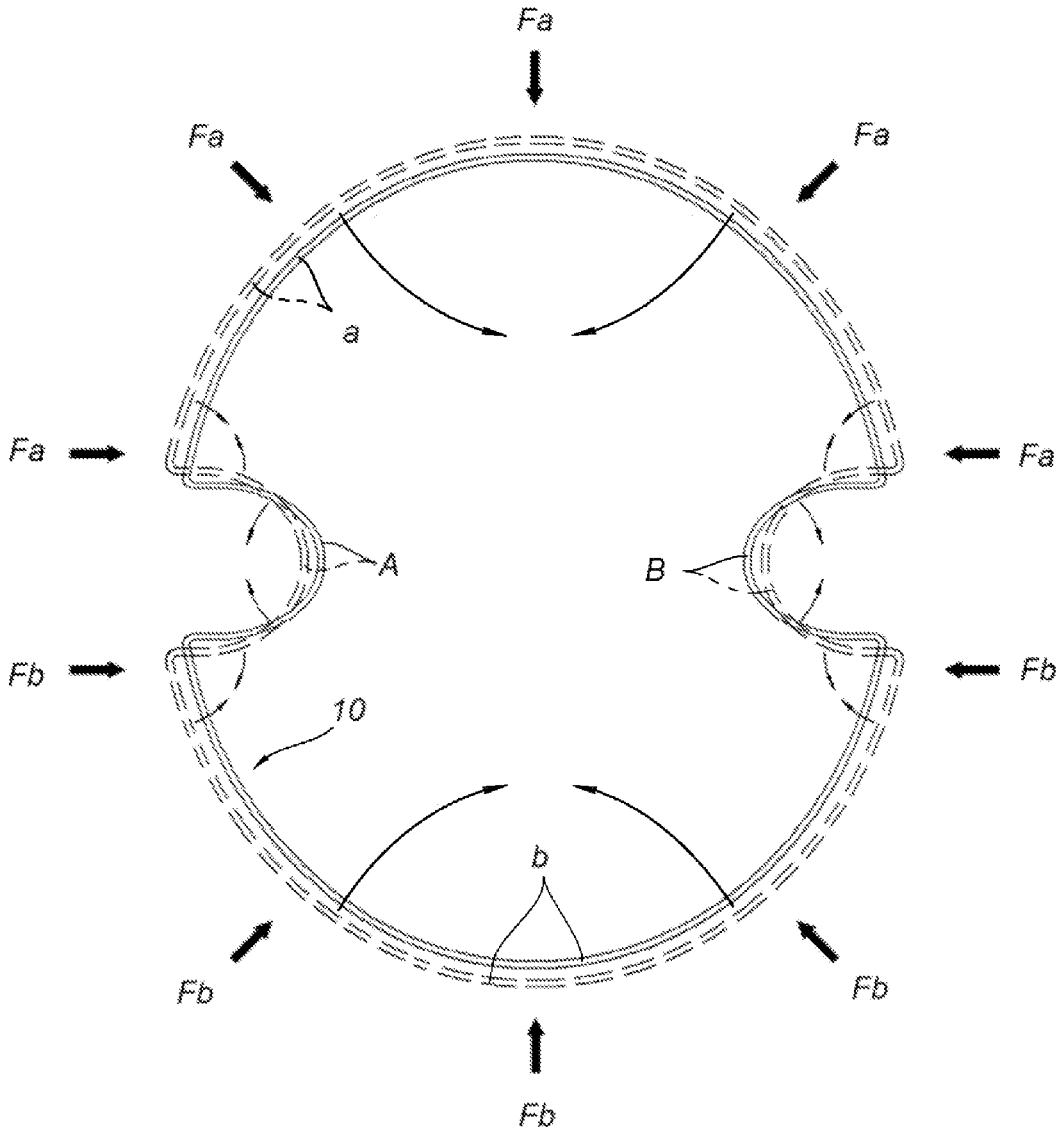
FIG. 6 is a top view comparison of the cap shaper in FIG. 5 in its free form (dashed lines) and its shape (solid lines) when inserted into the cap.

Referring to FIGS. 5 and 6, an alternative embodiment of the self-adapting cap shaper is disclosed for caps of generally around or elliptical top.

Cap 20 with the cap shaper 10 positioned in the cap are shown in FIG. 5; Illustrated in FIG. 6 is a comparison of the state of cap shaper 10 when positioned in cap 20 in solid lines, with that when its free in dashed lines; In this embodiment the cap shaper contact-members comprise smoothly and convexly curved sections a and b, and the buffer-sections include concavely curved sections A and B; When the cap shaper is positioned in the cap the smaller cap inside constrains the cap shaper and exerts distributed substantially radial contact forces over the sections a and b, labeled Fa and Fb respectively, causing the contact-sections a and b and the buffer-sections A and B to deform in the ways indicated by the arched arrows shown at respective sections; The deformation creates cap shaper shape restoring tension and its tendency to expand, facilitating self-adaptive cap shaping by the cap shaper, similarly as in the description for the embodiment shown in FIGS. 1, 2, 3, and 4.

Figure 7:
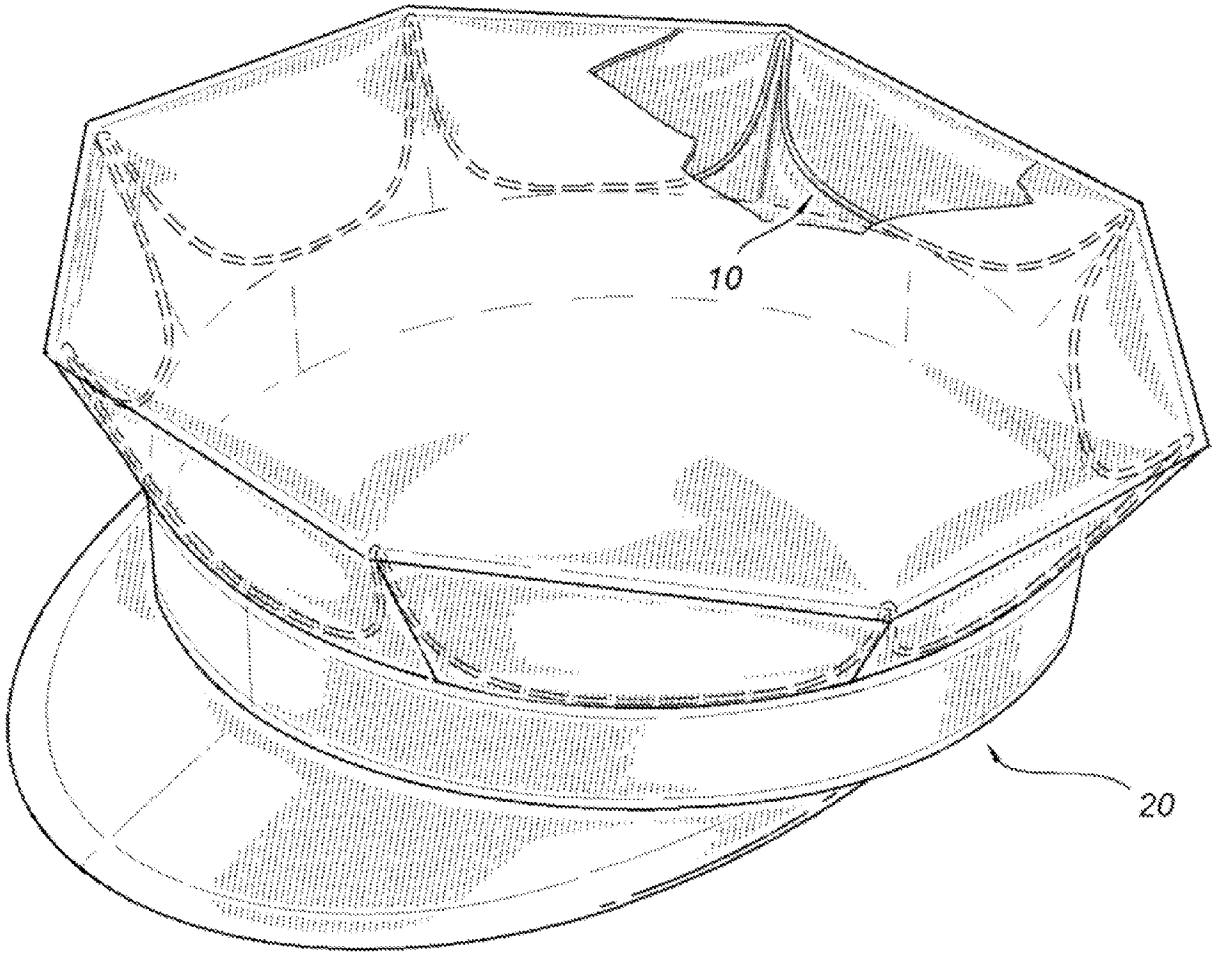
FIG. 7 is an exploded perspective view of a cap with a polygon top rim inserted with an alternative cap shaper embodiment of the current invention, non-planar in position.
Figure 8:
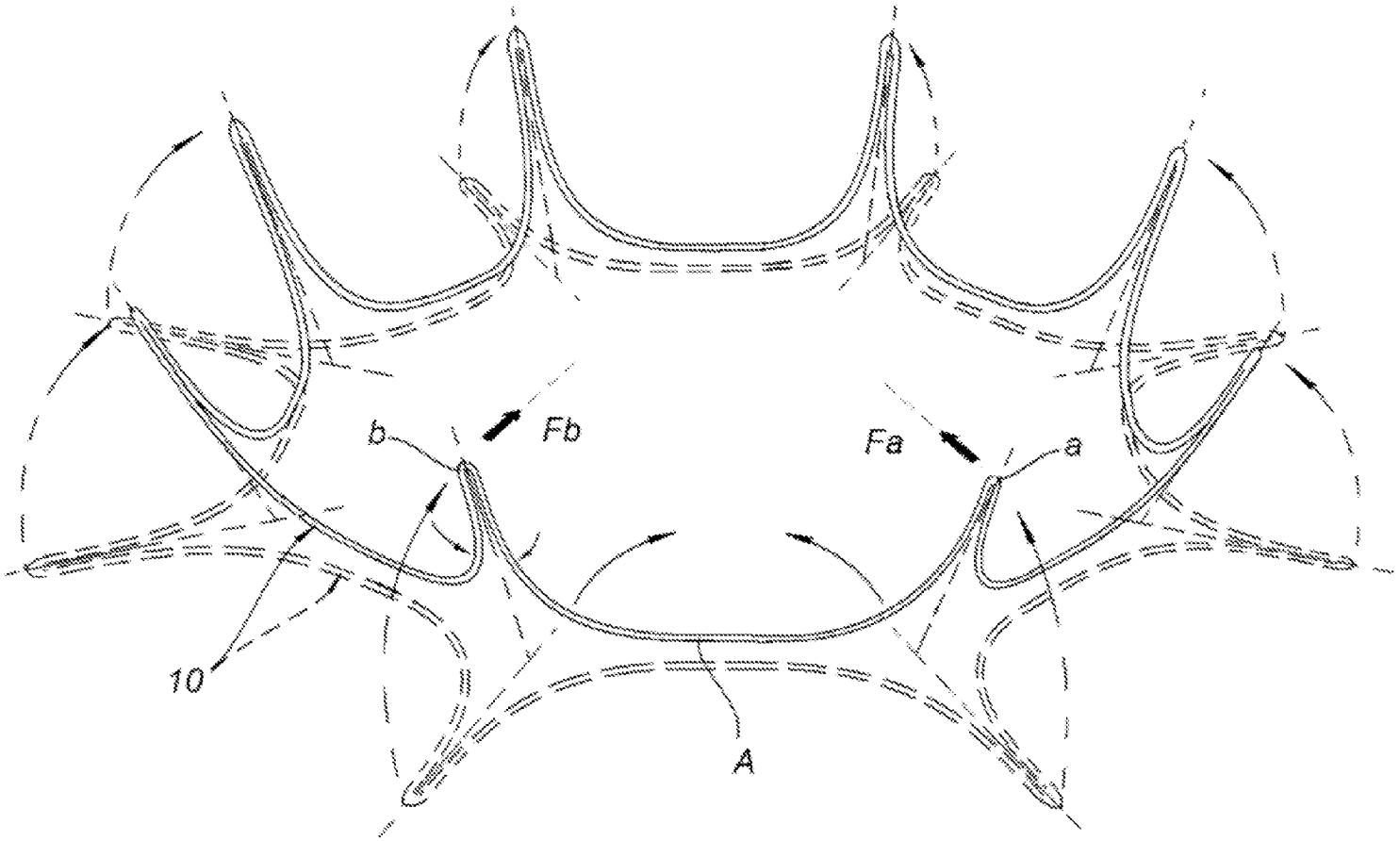
FIG. 8 is a prospective comparison of the cap shaper in FIG. 7 in its free form (dashed lines) and its shape (solid lines) when inserted into the cap.

Another alternative self-adapting cap shaper embodiment according to present invention for caps having a polygon shaped top, as that of the cap 20 in FIG. 1, is disclosed in FIGS. 7, 8; In this embodiment the cap shaper assumes a substantially three dimensional shape when positioned inside the cap with the contact-members in positions supporting the corresponding corners of the cap polygon top, and the buffer-sections contacting with and supporting the cap side walls, as shown in FIG. 7; When in its free state, the cap shaper of the current embodiment can be made as a generally planar frame loop if necessary, shown as the frame in dashed line in FIG. 8; When positioned in the cap the orientations of the contact-members are directed upward from its free state by the contact forces of the confines of the cap inside, resulting in cap shaper shape-restoring tension facilitating self-adaptive process for the contact-members to contact and support, under tension, the polygon corner positions as well as the cap side walls, hence shaping the cap.

In this embodiment the factors including the extent of the bends of the sections of the contact-members, the degree of the curvature of the buffer-sections, and the difference in between the cap shaper dimensions when it is in free state and that when it is positioned inside of the cap are optimized for the cap shaper to provide support and shaping for the cap side walls as well as its polygon top, as shown in FIG. 7.

I claim:

1. A cap shaper for shaping a non-rigid cap, comprising one or more contact-members, arranged and adapted for respectively contacting and supporting, under tension, a corresponding number of specific regions on the inside of the cap, the cap-shape-defining-regions, and interconnected or interjoined by elastic means for maintaining a generally larger dimension of a collective outline of the contact-members when the shaper is free from external forces, than that of the cap inside, enabling elastic deformation of the cap shaper and relative displacement of the contact-members in response to external forces exerted thereto, and generating cap shaper internal elastic tension counter-balancing the external forces;

when the cap shaper is placed inside of the cap with said contact-members in respective contact with said cap-shape-defining-regions of the cap, it deforms elastically under the confines of the smaller cap inside dimension by tensioned contacts of said contact-members with said cap-shape-defining-regions, elastically displacing contact-members due to the contact forces exerted thereto by cap-shape-defining-regions of the cap, resulting in its internal elastic tension and tendency to expand and substantially self-adapt the relative positions of said contact-members, as permitted by said elastic means, to fit in said cap-shape-defining-regions of the cap, accommodating minor cap size and shape variations, counter balancing the external contact forces and maintaining tensioned contact to shape the cap.

2. The cap shaper of claim 1, further comprises guide means for facilitating substantially self-adaptive physical aligning one of said contact-members to the corresponding one of said cap-shape-defining-regions in the process leading to tensioned contact of the contact-member with the corresponding cap-shape-defining-region.

3. The cap shaper of claim 2, wherein, the shape or structure of said contact-member is adapted in relationship with that of said corresponding cap-shape-defining-region and its immediate vicinity on the cap to form said guide means, having progressively smaller lateral physical acceptance for said contact-member formed by said immediate vicinity of the cap-shape-defining-region as said contact-member approaches progressively closer radially to said cap-shape-defining-region under the cap shaper internal elastic tension, and leading towards precise lateral alignment of said contact-member with said cap-shape-defining-region as said contact-member reaches the radial expansion limit at tensioned contact with said cap-shape-defining-region of the cap, during which process said elastic means of the cap shaper facilitates lateral displacement of said contact-member in response to the lateral guiding forces exerted to said contact-member by said lateral physical acceptance formed by said vicinity of the cap-shape-defining-region.

4. The cap shaper of claim 1, comprises:

a solid loop structure, inextensible loop-wise and transversely elastic, wherein, said contact-members are sections of said solid loop structure at locations around the loop corresponding to said cap-shape-defining-regions of the cap, having outward protruding shapes adapted for contacting and supporting said cap-shape-defining-regions under tension from the inside of the cap;

said elastic means comprises sections of said solid loop structure alternately located and joined with said contact-members, elastically bendable facilitating elastic deformation of the solid loop structure and displacements of said contact-members under external forces exerted thereto.

5. The cap shaper of claim 3, comprises:

a solid loop structure, inextensible loop-wise and transversely elastic, wherein, said contact-members are sections of said solid loop structure at locations around the loop corresponding to said cap-shape-defining-regions of the cap, having outward protruding shapes adapted for contacting and supporting said cap-shape-defining-regions under tension from the inside of the cap;

said elastic means comprises sections of said solid loop structure alternately located and joined with said contact-members, elastically bendable facilitating elastic deformation of the solid loop structure and displacements of said contact-members under external forces exerted thereto;

at least one of said contact-members has a corresponding one of said cap-shape-defining-region with immediate vicinity on the cap, concave in shape relative to the contact-member, forming said guide means.

6. A cap shaper for shaping a non-rigid cap, comprising a solid loop, inextensible loop-wise and transversely elastic, having one or more sections, the contact-sections, generally convexly bent protruding outward from the loop with shapes and locations adapted for tensioned contact and support with the cap at regions inside the cap, the shape-regions, respectively for shaping the cap;

said solid loop is elastically deformable facilitating relative elastic displacements of said contact-sections in response to external forces exerted thereto, and when free from external forces it maintains a generally larger dimension of a collective outline of said contact-sections than that of the cap inside;

when said solid loop of the cap shaper is placed inside of the cap with said contact-sections in contact respectively with said shape-sections of the cap, it is deformed elastically under the confines of the smaller cap inside dimension by tensioned contacts of said contact-sections with said respective shape-regions, elastically displacing contact-sections in response to the contact forces exerted thereto by the shape-regions of the cap, resulting in its internal elastic tension and tendency to expand and substantially self-adapt the relative positions of said contact-sections, as permitted by the elastic deformability of said loop, for said contact-sections to contact and fit in with said shape-regions of the cap, accommodating minor cap size and shape variations, counter balancing the external contact forces and maintaining the tensioned contact to shape the cap.

* * * * *